US008104542B2

(12) United States Patent
Ziemer et al.

(10) Patent No.: US 8,104,542 B2
(45) Date of Patent: Jan. 31, 2012

(54) PROCESS FOR PREPARING LOW-VISCOSITY POLYMER GELS

(75) Inventors: Antje Ziemer, Mannheim (DE); Anna Kowalski, Frankenthal (DE); Samantha Champ, Ludwigshafen (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 13/157,113

(22) Filed: Jun. 9, 2011

(65) Prior Publication Data

US 2011/0237724 A1 Sep. 29, 2011

Related U.S. Application Data

(62) Division of application No. 11/997,944, filed as application No. PCT/EP2006/065173 on Aug. 9, 2006, now abandoned.

(30) Foreign Application Priority Data

Aug. 23, 2005 (DE) ..... 10 2005 039 970

(51) Int. Cl.
*A62D 1/00* (2006.01)

(52) U.S. Cl. ..... 169/46; 524/556

(58) Field of Classification Search ..... 169/46
See application file for complete search history.

(56) References Cited

U.S. PATENT DOCUMENTS

| | | | | |
|---|---|---|---|---|
| 3,229,769 | A | 1/1966 | Bashaw et al. | |
| 4,247,435 | A * | 1/1981 | Kasten | 523/179 |
| 4,342,665 | A * | 8/1982 | Itoh et al. | 524/156 |
| 4,588,510 | A | 5/1986 | Salyer et al. | |
| 5,190,110 | A * | 3/1993 | von Blucher et al. | 169/46 |
| 5,849,210 | A | 12/1998 | Pascente et al. | |
| 5,989,446 | A * | 11/1999 | Hicks et al. | 252/8.05 |
| 6,265,444 | B1 | 7/2001 | Bowman et al. | |
| 6,469,080 | B2 | 10/2002 | Miyake et al. | |
| 7,670,513 | B2 * | 3/2010 | Erdner et al. | 252/610 |

FOREIGN PATENT DOCUMENTS

| | | |
|---|---|---|
| EP | 0 505 169 | 9/1992 |
| EP | 649669 | 4/1995 |
| WO | WO-2005/014115 A1 | 2/2005 |
| WO | WO 2005014115 A1 * | 2/2005 |

OTHER PUBLICATIONS

International Serach Report in PCT/EP2006/065173 dated Jan. 22, 2007.

* cited by examiner

*Primary Examiner* — Satya Sastri
(74) *Attorney, Agent, or Firm* — Marshall, Gerstein & Borun LLP

(57) ABSTRACT

The invention relates to a process for preparing low-viscosity polymer gels by mixing a water-absorbing polymer with water, in which the viscosity is reduced by adding a chelating agent, and also to the use thereof for firefighting.

9 Claims, No Drawings

PROCESS FOR PREPARING LOW-VISCOSITY POLYMER GELS

CROSS-REFERENCE TO RELATED APPLICATIONS

This is a divisional of U.S. patent application Ser. No. 11/997,944, filed Feb. 5, 2008, now abandoned, which is the U.S. national phase application of International Application No. PCT/EP2006/065173, filed Aug. 9, 2006, which claims the benefit of German patent application No. 10 2005 039 970.3, filed Aug. 23, 2005.

The present invention relates to a process for preparing low-viscosity polymer gels and to their use for firefighting.

Further embodiments of the present description can be taken from the claims, the description and the examples. It is self-evident that the features of the inventive subject-matter which have been specified above and will be illustrated below can be used not only in the combination specified in each case but also in other combinations without leaving the scope of the invention.

One problem in firefighting is that the water used for extinguishing runs off and can thus be utilized only partly to cool the seat of the fire. It is therefore necessary to use a very large amount of water with the consequence that the water damage is often greater than the damage caused purely by fire.

To solve this problem, the use of hydrogels has been proposed for over 35 years, for example in EP-A 0 649 669, U.S. Pat. No. 3,229,769 and U.S. Pat. No. 5,849,210. The hydrogels are prepared from a water-absorbing polymer and water. The hydrogel binds the water and thus prevents the water from flowing away from the seat of the fire.

EP-A 0 649 669 describes the use of water-absorbing polymers based on sodium acrylate as an extinguishing agent and as an extinguishing agent additive in water.

U.S. Pat. No. 3,229,769 discloses hydrogels based on ionically crosslinked polypotassium acrylates as fire-retardant coatings.

U.S. Pat. No. 5,849,210 discloses the use of hydrogels for firefighting, the hydrogels being prepared by using water-absorbing polymers based on sodium acrylate with a degree of neutralization around 75 mol %.

The swollen hydrogels are highly viscous and therefore pumpable only with difficulty.

It was an object of the present invention to provide a process for preparing low-viscosity and hence pumpable hydrogels for firefighting.

The object has been achieved by processes for preparing aqueous polymer gels by mixing at least one water-absorbing polymer with water, at least one chelating agent being used to reduce the viscosity.

Chelating agents are compounds having at least two functional groups, which are capable of chelate formation with polyvalent metal ions. Preferred functional groups are acid groups, especially carboxylic acid groups.

The at least one chelating agent comprises preferably at least one aminocarboxylic acid group, more preferably at least two aminocarboxylic acid groups.

The aminocarboxylic acid group is preferably an iminodiacetic acid group.

The acid groups of the chelating agent have preferably been neutralized, i.e. the chelating agent is preferably used in neutralized form.

Suitable chelating agents are, for example, the tetrasodium salt of ethylenediaminetetraacetic acid, the trisodium salt of methylglycinediacetic acid, the trisodium salt of hydroxyethylethylenediaminetriacetic acid and the pentasodium salt of diethylenediaminepentaacetic acid.

The concentration of the chelating agent in the polymer gel is typically at least 0.0001% by weight, preferably at least 0.005% by weight, more preferably at least 0.001% by weight, and typically up to 1% by weight, preferably up to 0.5% by weight, more preferably up to 0.1% by weight.

The preparation of the water-absorbing polymers is described, for example, in the monograph "Modern Superabsorbent Polymer Technology", F. L. Buchholz and A. T. Graham, Wiley-VCH, 1998, or in Ullmann's Encyclopedia of Industrial Chemistry, 6th Edition, Volume 35, pages 73 to 103.

The water-absorbing polymers are obtained, for example, by polymerization of a monomer solution comprising a) at least one ethylenically unsaturated acid-functional monomer,
b) at least one crosslinker,
c) if appropriate one or more ethylenically and/or allylically unsaturated monomers copolymerizable with the monomer a), and
d) if appropriate one or more water-soluble polymers onto which the monomers a), b) and if appropriate c) can be at least partly grafted.

Suitable monomers a) are, for example, ethylenically unsaturated carboxylic acids, such as acrylic acid, methacrylic acid, maleic acid, fumaric acid and itaconic acid, or derivatives thereof, such as acrylamide, methacrylamide, acrylic esters and methacrylic esters. Acrylic acid and methacrylic acid are particularly preferred. Acrylic acid is most preferable.

The monomers a) and especially acrylic acid comprise preferably up to 0.025% by weight of a hydroquinone monoether. Preferred hydroquinone monoethers are hydroquinone monomethyl ether (MEHQ) and/or tocopherols.

Tocopherol refers to compounds of the following formula:

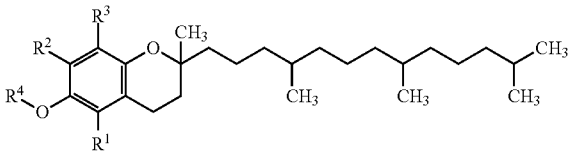

where $R^1$ is hydrogen or methyl, $R^2$ is hydrogen or methyl, $R^3$ is hydrogen or methyl and $R^4$ is hydrogen or an acyl radical of 1 to 20 carbon atoms.

Preferred $R^4$ radicals are acetyl, ascorbyl, succinyl, nicotinyl and other physiologically tolerable carboxylic acids. The carboxylic acids can be mono-, di- or tricarboxylic acids.

Preference is given to alpha-tocopherol where $R^1$=$R^2$=$R^3$=methyl, especially racemic alpha-tocopherol. $R^1$ is more preferably hydrogen or acetyl. RRR-alpha-tocopherol is preferred in particular.

The monomer solution comprises preferably not more than 130 ppm by weight, more preferably not more than 70 ppm by weight, preferably not less than 10 ppm by weight, more preferably not less than 30 ppm by weight and especially about 50 ppm by weight of hydroquinone monoether, all based on acrylic acid, with acrylic acid salts being counted as acrylic acid. For example, the monomer solution can be produced using an acrylic acid having an appropriate hydroquinone monoether content.

The crosslinkers b) are compounds having at least two polymerizable groups which can be free-radically interpolymerized into the polymer network. Suitable crosslinkers b) are for example ethylene glycol dimethacrylate, diethylene glycol diacrylate, allyl methacrylate, trimethylolpropane triacrylate, triallylamine, tetraallyloxyethane, as described in EP-A-0 530 438, di- and triacrylates, as described in EP-A0 547 847, EP-A 0 559 476, EP-A 0 632 068, WO 93/21237, WO 03/104299, WO 03/104300, WO 03/104301 and DE-A 103 31 450, mixed acrylates which, as well as acrylate groups, comprise further ethylenically unsaturated groups, as described in DE-A 103 31 456 and WO 04/013064, or crosslinker mixtures as described for example in DE-A 195 43 368, DE-A 196 46 484, WO 90/15830 and WO 02/32962.

Useful crosslinkers b) include in particular N,N'-methylenebisacrylamide and N,N'-methylenebismethacrylamide, esters of unsaturated mono- or polycarboxylic acids of polyols, such as diacrylate or triacrylate, for example butanediol diacrylate, butanediol dimethacrylate, ethylene glycol diacrylate, ethylene glycol dimethacrylate and also trimethylolpropane triacrylate and allyl compounds, such as allyl (meth) acrylate, triallyl cyanurate, diallyl maleate, polyallyl esters, tetraallyloxyethane, triallylamine, tetraallylethylenediamine, allyl esters of phosphoric acid and also vinylphosphonic acid derivatives as described for example in EP-A 0 343 427. Useful crosslinkers b) further include pentaerythritol diallyl ether, pentaerythritol triallyl ether, pentaerythritol tetraallyl ether, polyethylene glycol diallyl ether, ethylene glycol diallyl ether, glycerol diallyl ether, glycerol triallyl ether, polyallyl ethers based on sorbitol, and also ethoxylated variants thereof. The process of the invention utilizes di(meth)acrylates of polyethylene glycols, the polyethylene glycol used having a molecular weight between 300 and 1000.

However, particularly advantageous crosslinkers b) are di- and triacrylates of 3- to 15-tuply ethoxylated glycerol, of 3- to 15-tuply ethoxylated trimethylolpropane, of 3- to 15-tuply ethoxylated trimethylolethane, especially di- and triacrylates of 2- to 6-tuply ethoxylated glycerol or of 2- to 6-tuply ethoxylated trimethylolpropane, of 3-tuply propoxylated glycerol, of 3-tuply propoxylated trimethylolpropane, and also of 3-tuply mixedly ethoxylated or propoxylated glycerol, of 3-tuply mixedly ethoxylated or propoxylated trimethylolpropane, of 15-tuply ethoxylated glycerol, of 15-tuply ethoxylated trimethylolpropane, of 40-tuply ethoxylated glycerol, of 40-tuply ethoxylated trimethylolethane and also of 40-tuply ethoxylated trimethylolpropane.

Very particularly preferred for use as crosslinkers b) are diacrylated, dimethacrylated, triacrylated or trimethacrylated multiply ethoxylated and/or propoxylated glycerols as described for example in WO 03/104301. Di- and/or triacrylates of 3- to 10-tuply ethoxylated glycerol are particularly advantageous. Very particular preference is given to di- or triacrylates of 1- to 5-tuply ethoxylated and/or propoxylated glycerol. The triacrylates of 3- to 5-tuply ethoxylated and/or propoxylated glycerol are most preferred. These are notable for particularly low residual levels (typically below 10 ppm by weight) in the water-absorbing polymer and the aqueous extracts of water-absorbing polymers produced therewith have an almost unchanged surface tension (typically not less than 0.068 N/m) compared with water at the same temperature.

Examples of ethylenically unsaturated monomers c) which are copolymerizable with the monomers a) are acrylamide, methacrylamide, crotonamide, dimethylaminoethyl methacrylate, dimethylaminoethyl acrylate, dimethylaminopropyl acrylate, diethylaminopropyl acrylate, dimethylaminobutyl acrylate, dimethylaminoethyl methacrylate, diethylaminoethyl methacrylate, dimethylaminoneopentyl acrylate and dimethylaminoneopentyl methacrylate.

Useful water-soluble polymers d) include polyvinyl alcohol, polyvinylpyrrolidone, starch, starch derivatives, polyglycols or polyacrylic acids, preferably polyvinyl alcohol and starch.

Polymerization inhibitors, which are preferred, require dissolved oxygen for optimum performance. Therefore, polymerization inhibitors may be freed of dissolved oxygen prior to polymerization by inertization. i.e., flowing an inert gas, preferably nitrogen, through them. The oxygen content of the monomer solution is preferably lowered to less than 1 ppm by weight and more preferably to less than 0.5 ppm by weight prior to polymerization.

The preparation of a suitable base polymer and also further useful hydrophilic ethylenically unsaturated monomers d) are described in DE-A 199 941 423, EP-A 0 686 650, WO 01/45758 and WO 03/104300.

Water-absorbing polymers are typically obtained by addition polymerization of an aqueous monomer solution with or without subsequent comminution of the hydrogel. Suitable methods of making are described in the literature. Water-absorbing polymers are obtainable for example by

- gel polymerization in the batch process or tubular reactor and subsequent comminution in meat grinder, extruder or kneader (EP-A-0 445 619, DE-A-19 846 413)
- addition polymerization in kneader with continuous comminution by contrarotatory stirring shafts for example (WO-A-01/38402)
- addition polymerization on belt and subsequent comminution in meat grinder, extruder or kneader (DE-A-38 25 366, U.S. Pat. No. 6,241,928)
- emulsion polymerization, which produces bead polymers having a relatively narrow gel size distribution (EP-A-0 457 660)
- in situ addition polymerization of a woven fabric layer which, usually in a continuous operation, has previously been sprayed with aqueous monomer solution and subsequently been subjected to a photopolymerization (WO-A-02/94328, WO-A-02/94329).

The reaction is preferably carried out in a kneader as described for example in WO 01/38402, or on a belt reactor as described for example in EP-A 0 955 086.

The acid groups of the hydrogels obtained have typically been partially neutralized, preferably to an extent of in the range from 25 to 85 mol %, more preferably to an extent of in the range from 27 to 80 mol % and even more preferably to an extent of in the range from 27 to 30 mol % or 40 to 75 mol %, for which the customary neutralizing agents can be used, preferably alkali metal hydroxides, alkali metal oxides, alkali metal carbonates or alkali metal bicarbonates and also mixtures thereof. Instead of alkali metal salts it is also possible to use ammonium salts. Sodium and potassium are particularly preferred as alkali metals, but most preference is given to sodium hydroxide, sodium carbonate or sodium bicarbonate and also mixtures thereof. Neutralization is customarily achieved by admixing the neutralizing agent as an aqueous solution or else preferably as a solid material. For example, sodium hydroxide having a water content of distinctly below 50% by weight can be present as a waxy mass having a melting point of above 23° C. In this case, metering as piece-goods or melt at elevated temperature is possible.

Neutralization can be carried out after polymerization, at the hydrogel stage. But it is also possible to neutralize up to 40 mol %, preferably from 10 to 30 mol % and more preferably from 15 to 25 mol % of the acid groups before polymerization by adding a portion of the neutralizing agent to the monomer solution and setting the desired final degree of neutralization only after polymerization, at the hydrogel stage. The monomer solution can be neutralized by admixing the neutralizing agent. The hydrogel may be mechanically comminuted, for example by means of a meat grinder, in which case the neutralizing agent can be sprayed, sprinkled or poured on and then carefully mixed in. To this end, the gel mass obtained can be repeatedly meat-grindered for homogenization. Neutralization of the monomer solution to the final degree of neutralization is preferred.

The neutralized hydrogel is then dried with a belt or drum dryer until the residual moisture content is preferably below 15% by weight and especially below 10% by weight, the water content being determined by EDANA (European Disposables and Nonwovens Association) recommended test method No. 430.2-02 "Moisture content". Selectively, drying can also be carried out using a fluidized bed dryer or a heated plowshare mixer. To obtain particularly white products, it is advantageous to dry this gel by ensuring rapid removal of the evaporating water. To this end, the dryer temperature must be optimized, the air feed and removal has to be policed, and at all times sufficient venting must be ensured. Drying is naturally all the more simple—and the product all the more white—when the solids content of the gel is as high as possible. The solids content of the gel prior to drying is therefore preferably between 30% and 80% by weight. It is particularly advantageous to vent the dryer with nitrogen or some other nonoxidizing inert gas. If desired, however, simply just the partial pressure of the oxygen can be lowered during drying to prevent oxidative yellowing processes. In general, adequate venting and removal of the water vapor will, though, likewise still lead to an acceptable product. A very short drying time is generally advantageous with regard to color and product quality.

A further important function of drying the gel is the ongoing reduction in the residual monomer content of the superabsorbent. This is because any residual initiator will decompose during drying, leading to any residual monomers becoming interpolymerized. In addition, the evaporating amounts of water will entrain any free water vapor-volatile monomers still present, such as acrylic acid for example, and thus likewise lower the residual monomer content of the superabsorbent.

The dried hydrogel is preferably ground and sieved, useful grinding apparatus typically including roll mills, pin mills or swing mills. The particle size of the sieved, dry hydrogel is preferably below 1000 μm, more preferably below 900 μm and most preferably below 800 μm and preferably above 100 μm, more preferably above 150 μm and most preferably above 200 μm.

Very particular preference is given to a particle size (sieve cut) in the range from 106 to 850 μm. The particle size is determined according to EDANA (European Disposables and Nonwovens Association) recommended test method No. 420.2-02 "Particle size distribution".

The base polymers are then preferably surface postcrosslinked. Useful postcrosslinkers are compounds comprising two or more groups capable of forming covalent bonds with the carboxylate groups of the hydrogel. Suitable compounds are for example alkoxysilyl compounds, polyaziridines, polyamines, polyamidoamines, di- or polyepoxides, as described in EP-A 0 083 022, EP-A 0 543 303 and EP-A 0 937 736, di- or polyfunctional alcohols, as described in DE-C 33 14 019, DE-C 35 23 617 and EP-A 0 450 922, or β-hydroxyalkylamines, as described in DE-A 102 04 938 and U.S. Pat. No. 6,239,230.

Useful surface postcrosslinkers are further said to include by DE-A 40 20 780 cyclic carbonates, by DE-A 198 07 502 2-oxazolidone and its derivatives, such as 2-hydroxyethyl-2-oxazolidone, by DE-A 198 07 992 bis- and poly-2-oxazolidinones, by DE-A 198 54 573 2-oxotetrahydro-1,3-oxazine and its derivatives, by DE-A 198 54 574 N-acyl-2-oxazolidines, by DE-A 102 04 937 cyclic ureas, by DE-A 103 34 584 bicyclic amide acetals, by EP-A 1 199 327 oxetanes and cyclic ureas and by WO 03/031482 morpholine-2,3-dione and its derivatives.

Postcrosslinking is typically carried out by spraying a solution of the surface postcrosslinker onto the hydrogel or onto the dry base-polymeric powder. After spraying, the polymeric powder is thermally dried, and the crosslinking reaction may take place not only before but also during drying.

The spraying with a solution of the crosslinker is preferably carried out in mixers having moving mixing implements, such as screw mixers, paddle mixers, disk mixers, plowshare mixers and shovel mixers. Particular preference is given to vertical mixers and very particular preference to plowshare mixers and shovel mixers. Useful mixers include for example Lödige® mixers, Bepex® mixers, Nauta® mixers, Processall® mixers and Schugi® mixers.

Contact dryers are preferable, shovel dryers more preferable and disk dryers most preferable as apparatus in which thermal drying is carried out. Useful dryers include for example Bepex® dryers and Nara® dryers. Fluidized bed dryers can be used as well.

Drying may take place in the mixer itself, by heating the jacket or introducing a stream of warm air. It is similarly possible to use a downstream dryer, for example a tray dryer, a rotary tube oven or a heatable screw. It is also possible, for example, to utilize an azeotropic distillation as a drying process.

Preferred drying temperatures are in the range from 50 to 250° C., preferably in the range from 50 to 200° C. and more preferably in the range from 50 to 150° C. The preferred residence time at this temperature in the reaction mixer or dryer is below 30 minutes and more preferably below 10 minutes.

The concentration of the water-absorbing polymer in the polymer gel is typically at least 0.05% by weight, preferably at least 0.5% by weight, more preferably at least 1% by weight, and typically up to 10% by weight, preferably up to 5% by weight, more preferably up to 2.5% by weight.

In the case of the preparation of homogeneous polymer gels, i.e. of polymer gels in which no concentration gradient is established even in the course of prolonged storage, for example one hour, it is to be noted that the amount of water used should not exceed the swellability of the water-absorbing polymers used, it being possible that the chelating agent used additionally has an influence on the swellability. The preparation of homogeneous polymer gels is preferred.

A concentration gradient is formed, for example, when too much water has been used in relation to the swellability of the water-absorbing polymer and the swollen polymer settles in the excess water.

The way in which the components of the polymer gel are mixed is not subject to any restriction. For example, stirrers or kneaders may be used. It is also possible to initially charge water and to pump it in circulation, in which case chelating agent and water-absorbing polymer are added.

In a preferred embodiment, the chelating agent is premixed with water and the water-absorbing polymer is subsequently added, preferably stirred in.

Polyvalent cations can reduce the viscosity of the polymer gel further. Suitable polyvalent cations are, for example. $Ca^{++}$ and $Mg^{++}$. Advantageously, the cations are metered in in the form of their salts and before the addition of the water-absorbing polymer.

The concentration of the polyvalent cation in the polymer gel is preferably at least 0.0001% by weight, more preferably at least 0.005% by weight, most preferably at least 0.001% by weight, and preferably up to 0.1% by weight, more preferably up to 0.05% by weight, most preferably up to 0.01% by weight.

The present invention further provides for the use of the low-viscosity polymer gels prepared by the process according to the invention for firefighting.

The viscosity of the low-viscosity polymer gels can be measured by customary methods which are suitable for determining relatively high viscosities, for example with rotational viscometers.

EXAMPLES

Example 1

Preparation of the Water-Absorbing Polymer

In a glass beaker with an edge height of approx. 20 cm and a diameter of approx. 18.5 cm, a solution of 50 g of water, 747.5 g of acrylic acid, 181.2 g of potassium carbonate, 449.6 g of an aqueous 45% by weight potassium hydroxide solution, 0.288 g of methylenebisacrylamide, 9.97 g of a 14.7% by weight aqueous 2,2'-azobis(2-amidinopropane) dihydrochloride solution and 6.34 g of a 10% by weight sodium persulfate solution was prepared. The solution was transferred to a polytetrafluoroethylene vessel with an edge height of approx. 25 cm and a diameter of approx. 10 cm and inertized with nitrogen for about 10 minutes. The polymerization was started by adding a few drops of a 33% by weight aqueous sodium persulfate solution and a few drops of a 33% by weight sodium hydrogen sulfite solution. Polymerization reaction afforded a gel cylinder which was comminuted mechanically by means of a meat grinder, dried in a forced-air drying cabinet at 160° C. and ground with an ultracentrifugal mill. Subsequently, the sieve fraction from 106 to 850 μm was isolated.

100 g of the dried base polymer were initially charged in a Waring laboratory mixer which had been equipped with an attachment with blunt mixing blades. At moderate rotational speed, 0.07 g of ethylene glycol diglycidyl ether dissolved in 2 g of 1,2-propanediol and 1 g of water was then added slowly with stirring by means of an injection syringe through a hole in the lid of the mixing attachment, in order to wet the base polymer as uniformly as possible.

The moistened polymer was homogenized by stirring and then heat-treated at 150° C. on a watchglass in a forced-air drying cabinet for 60 minutes. Finally, it was sieved through an 850 μm sieve in order to remove lumps.

Example 2

Comparative Example 2 g of the water-absorbing polymer prepared in example 1 were stirred into 198 g of demineralized water. Subsequently, the viscosity of the polymer gel was measured.

A "Brookfield R/Rheometer" viscometer with the following settings was used:

Measurement type: CSR rotational speed control
Measurement system, geometry: V40203TO1
Measurement time: 180 s
Start value: 0 rpm
End value: 150 rpm
MP: 90

For the measurement, 200 g of polymer gel were introduced into a 250 ml glass bottle. The measurements were carried out at 23° C. The viscosities were evaluated at 20, 60 and 150 revolutions/minute (rpm).

Example 3

The procedure of example 2 was repeated. Instead of demineralized water, a solution of 1 g of Trilon® B (40% by weight solution of the tetrasodium salt of ethylenediaminetetraacetic acid; BASF Aktiengesellschaft; Germany) and 1 l of demineralized water was used. The resulting polymer gel was stirred at 80° C. overnight (approx. 17 hours). Subsequently, the viscosity of the polymer gel was measured.

Example 4

The procedure of example 2 was repeated. Instead of demineralized water, a solution of 1 g of Trilon® M (40% by weight solution of the trisodium salt of methylglycinediacetic acid; BASF Aktiengesellschaft; Germany) and 1 l of demineralized water was used. The resulting polymer gel was stirred at 80° C. overnight (approx. 17 hours). Subsequently, the viscosity of the polymer gel was measured.

Example 5

The procedure of example 2 was repeated. Instead of demineralized water, a solution of 1 g of Triton® D (40% by weight solution of the trisodium salt of hydroxyethylethylenediaminetriacetic acid; BASF Aktiengesellschaft; Germany) and 1 l of demineralized water was used. The resulting polymer gel was stirred at 80° C. overnight (approx. 17 hours). Subsequently, the viscosity of the polymer gel was measured.

Example 6

The procedure of example 2 was repeated. Instead of demineralized water, a solution of 0.5 g of Trilon® C (40% by weight solution of the pentasodium salt of diethylenediaminepentaacetic acid; BASF Aktiengesellschaft; Germany) and 1 l of demineralized water was used. The resulting polymer gel was stirred at 80° C. overnight (approx. 17 hours). Subsequently, the viscosity of the polymer gel was measured.

TABLE 1

Viscosities of the polymer gels without cation addition

| Example | Viscosity [mPas] at 20 rpm | Viscosity [mPas] at 60 rpm | Viscosity [mPas] at 150 rpm |
|---|---|---|---|
| 2 (comparative) | 65 587 | 24 749 | 11 387 |
| 3 | 33 082 | 18 281 | 6080 |
| 4 | 34 862 | 14 126 | 6409 |
| 5 | 37 862 | 14 647 | 6786 |
| 6 | 37 869 | 14 647 | 6786 |

Examples 7 to 10

The procedure of example 3 was repeated. Instead of demineralized water, aqueous $CaCl_2$ solutions which had been obtained by dissolving $CaCl_2 \cdot 6H_2O$ in demineralized water were used.

TABLE 2

Viscosities of the polymer gels with addition of cations

| Example | $CaCl_2 \cdot 6\ H_2O$ [mg/1000 g of solution] | Viscosity [mPas] at 20 rpm | Viscosity [mPas] at 60 rpm | Viscosity [mPas] at 150 rpm |
|---|---|---|---|---|
| 3 | | 33 082 | 18 281 | 6080 |
| 7 | 109.49 | 31 133 | 12 473 | 5921 |
| 8 | 547.45 | 23 178 | 8835 | 4218 |
| 9 | 1094.9 | 10 826 | 4170 | 2013 |
| 10 | 1642.35 | 3429 | 1314 | 650 |

Examples 7 to 10 show that the viscosity of the polymer gels can be lowered further by adding polyvalent cations.

What is claimed is:

1. A method of extinguishing a fire comprising applying an aqueous polymer gel to the fire, wherein the aqueous polymer gel comprises (a) at least one water-absorbing polymer having been produced by polymerizing a monomer solution comprising at least one ethylenically unsaturated acid-functional monomer and at least one crosslinker, (b) water and (c) at least one chelating agent to reduce the viscosity of the gel.

2. The process according to claim 1, wherein the water and the at least one chelating agent are premixed.

3. The process according to claim 1, wherein the polymer gel comprises from 0.05 to 10% by weight of the at least one water-absorbing polymer.

4. The process according to claim 1, wherein the polymer gel comprises from 0.0001 to 1% by weight of the at least one chelating agent.

5. The process according to claim 1, wherein the at least one chelating agent comprises at least one aminocarboxylic acid group.

6. The process according to claim 5, wherein the at least one aminocarboxylic acid group has been neutralized.

7. The process according to claim 1, wherein at least one polyvalent cation has additionally been mixed into the gel.

8. The process according to claim 7, wherein a concentration of the at least one polyvalent cation is from 0.0001 to 0.1% by weight.

9. The process according to claim 7, wherein the at least one cation is $Ca^{++}$.

* * * * *